US006659314B2

(12) United States Patent
Garcia

(10) Patent No.: US 6,659,314 B2
(45) Date of Patent: Dec. 9, 2003

(54) FLUID DISPENSER HAVING A RECESSED RESERVOIR

(75) Inventor: Firmin Garcia, Evreux (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/870,788

(22) Filed: Jun. 1, 2001

(65) Prior Publication Data

US 2002/0003152 A1 Jan. 10, 2002

(30) Foreign Application Priority Data

Jun. 23, 2000 (FR) ..... 00 08101

(51) Int. Cl.[7] ..... B67D 5/60
(52) U.S. Cl. ..... 222/540; 222/143; 222/321.7
(58) Field of Search ..... 222/321.1, 321.7, 222/321.8, 321.9, 320, 540, 402.11, 402.13, 575, 153.13, 143

(56) References Cited

U.S. PATENT DOCUMENTS 2,412,728 A * 12/1946 Goodhue ..... 222/394
2,537,226 A * 1/1951 Lindsey ..... 239/337
3,407,975 A 10/1968 Schroeder
3,782,602 A * 1/1974 Page ..... 222/143
4,143,795 A * 3/1979 Casebier ..... 222/143
4,371,097 A * 2/1983 O'Neill ..... 222/321.7
4,620,646 A * 11/1986 Crapser ..... 222/153.11
4,776,491 A 10/1988 Nitta
5,601,211 A * 2/1997 Foster ..... 222/143
6,343,714 B1 * 2/2002 Tichenor ..... 222/153.11
6,349,855 B1 * 2/2002 Borri ..... 222/182
6,390,338 B1 * 5/2002 Baudin ..... 222/321.2

FOREIGN PATENT DOCUMENTS

WO WO 89/03793 5/1989

* cited by examiner

*Primary Examiner*—Kevin Shaver
*Assistant Examiner*—Stephanie Willatt
(74) *Attorney, Agent, or Firm*—Sughrue Mion, PLLC

(57) ABSTRACT

A fluid dispenser, including a reservoir containing a fluid, the reservoir being provided with an opening and defining a maximum overall size and having a recess; and a dispenser member such as a pump or a valve, fitted to the opening of the reservoir. The dispenser member lies within the recess of the reservoir.

27 Claims, 1 Drawing Sheet

FLUID DISPENSER HAVING A RECESSED RESERVOIR

The present invention relates to a fluid dispenser comprising a reservoir containing a fluid, and a dispenser such as a pump or a valve fitted to the reservoir. This is quite a conventional design for a fluid dispenser in the fields of perfumes, of cosmetics, or indeed of pharmaceuticals. This type of dispenser is used in particular for dispensing fluid substances ranging from liquids to semi-liquids.

BACKGROUND OF THE INVENTION

In general, the reservoir, which can be made of glass, of plastic, or even of metal, is provided with a neck that defines an opening in which the pump or valve is fitted. The neck of the reservoir defines the top portion of the reservoir so that the pump or the valve fitted to the neck projects from the reservoir.

Conventionally, it is possible to provide a cover that fits over the pump or the valve to protect it from dust and also from impacts since the pump or the valve is directly exposed because of its position at the top end of the reservoir. If the dispenser is dropped, it might fall on the pump or the valve, which can damage it and make the dispenser unusable.

OBJECTS AND SUMMARY OF THE INVENTION

An object of the present invention is to remedy the above-mentioned drawbacks of the prior art by defining a fluid dispenser that offers increased protection for the pump or for the valve in the event that it is dropped. Another object of the present invention is to make it possible to omit a protective cover for the pump or the valve while retaining or even improving the protection therefor.

To this end, the present invention provides a fluid dispenser comprising:

- a reservoir containing a fluid, said reservoir being provided with an opening and defining a maximum overall size; and
- a dispenser member such as a pump or a valve, fitted to the opening of the reservoir;
- wherein the dispenser member lies entirely within the maximum overall size of the reservoir.

The term "maximum overall size" is used to mean the maximum overall dimensions of the reservoir that define a total volume which is not necessarily occupied by said reservoir. Advantageously, the reservoir forms a recess in which the opening is situated, said dispenser member being entirely received in said recess, so that the dispenser can be disposed in any position on a substantially plane surface without the dispenser member coming into contact with said surface. Preferably, the reservoir forms a recess whose bottom is provided with the opening. In which case, the width of the recess is greater than or equal to the width of the dispenser member. In addition, the height of the recess is greater than or equal to the height of the portion of the dispenser member that projects from the opening.

In another characteristic, the reservoir forms a protuberance on each side of the recess.

Given that the pump or the valve is received entirely within the recess formed by the reservoir, it is well protected in the event that it is dropped since there is no risk of it hitting the ground. It is therefore possible to omit fitting the pump or the valve with a protective cover.

BRIEF DESCRIPTION OF THE DRAWING

The invention is described more fully below with reference to the accompanying drawings which show an embodiment of the present invention by way of example.

In the figures.

MORE DETAILED DESCRIPTION

Figure 1:
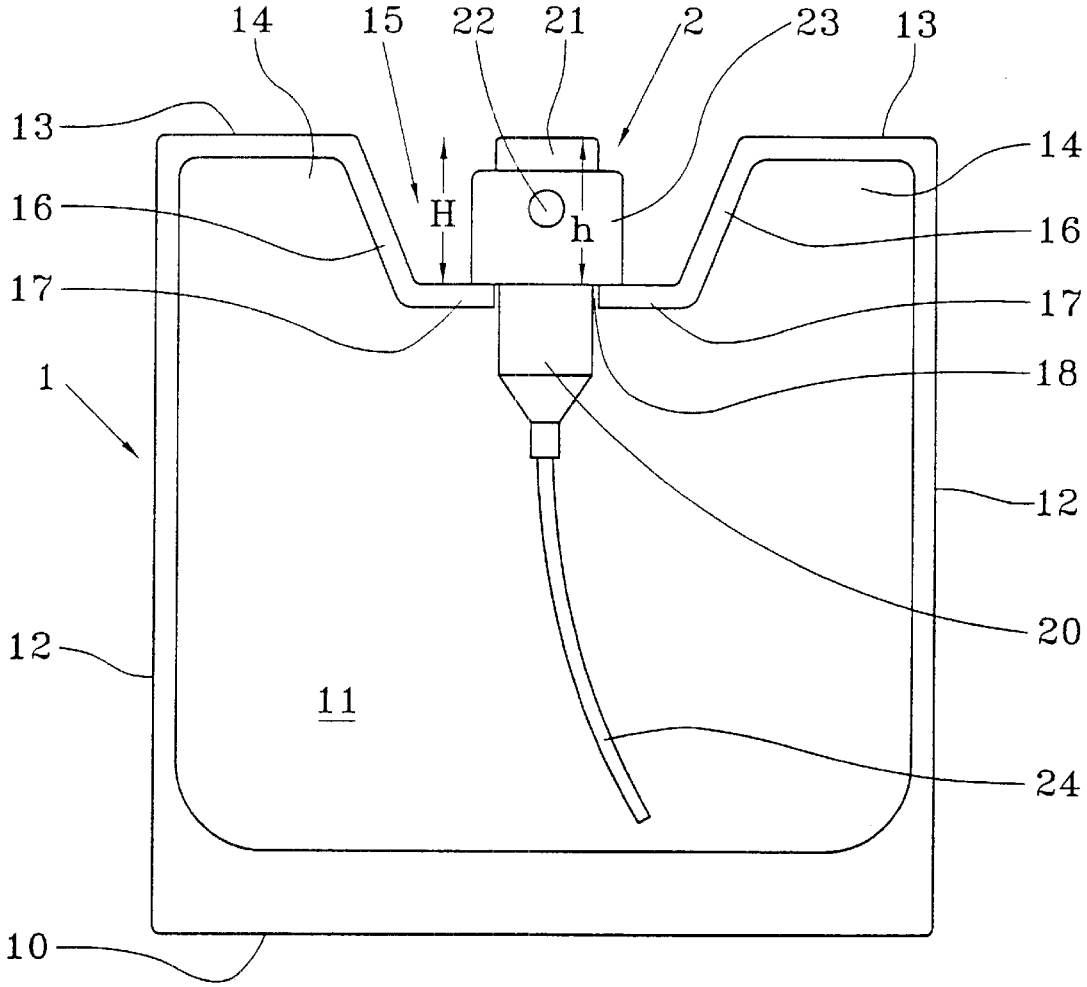
FIG. 1 is a vertical section view through a fluid dispenser of the invention.
Figure 2:
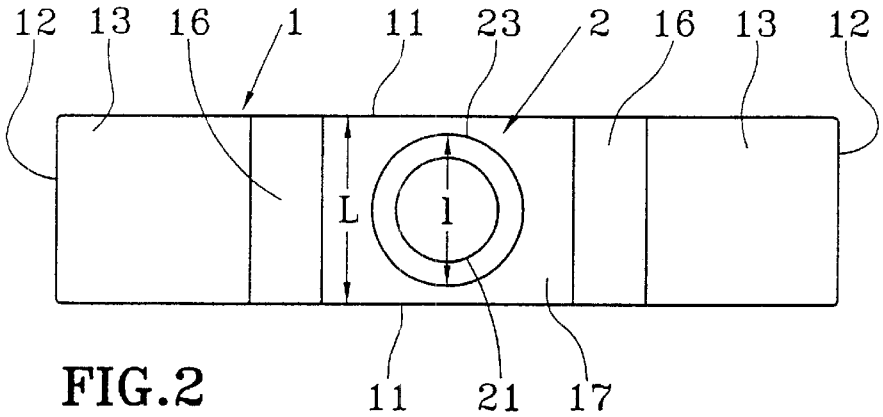
FIG. 2 is a plan view of the dispenser of FIG. 1.

The fluid dispenser shown in FIGS. 1 and 2 represents an embodiment of the invention. It comprises two component parts, namely a reservoir 1 and a dispenser member 2 which may be a valve or a pump. For reasons of clarity and simplicity, we assume that the dispenser member is a pump.

The reservoir 1 includes a bottom 10 via which the dispenser normally stands on a surface so as to hold the dispenser upright. The reservoir extends upwards from the bottom 10 to define a reservoir body that may have any of a very wide variety of cross-sectional shapes. In the example used to illustrate the present invention, the reservoir body is of rectangular cross-section and it therefore defines four side walls 11 and 12. The reservoir body is thus substantially cylindrical but of rectangular section. Naturally, it is possible to consider any sectional shape for the body of the reservoir, even non-cylindrical.

In the invention, the top end of the reservoir 1 is provided with a recess 15 which forms respective notches in the side walls 11. The recess 15 is formed in the top wall 13 and in the side walls 11 of the reservoir. Therefore, the recess 15 forms a depression in the top wall 13. The recess 15 comprises a bottom 17 and two side flanks 16 that interconnect the top wall 13 and the bottom 17 and that interconnect the two side walls 11. In this example, the bottom 17 and the side flanks 16 are in the form of rectilinear plane surfaces, but it is also possible to consider a half-cylinder shaped recess.

In the invention, the opening 18 in the reservoir 1, to which opening the pump 2 is fitted, is defined in the bottom 17 of the recess 15.

Since the recess 15 forms a depression in the top wall 13, the maximum overall size of the reservoir 1 is defined by the bottom 10, by the side walls 11 and 12, and by the top wall 13.

The pump 2 comprises a pump body 20 with a dip tube 24 that extends inside the reservoir. The pump 2 further comprises a pusher 21 which is depressed in order to actuate the pump 2 so as to dispense the fluid. The pump 2 further comprises trim 23 in which a spray nozzle 22 is formed, via which the fluid is dispensed in the form of a spray. The trim 23 makes it possible to mask the body 20 and the neck (not shown) of the reservoir.

In the invention, the portion of the pump 2 that is situated above the bottom 17 of the recess 15 is fully received inside the recess 15 so that the pump does not project relative to the side walls 11 or relative to the top wall 13. It can be said that the pump 2 then lies entirely within the maximum overall size of the reservoir. For this purpose, the height of the pump 2 above the bottom 17, designated by the letter h, is less than the height H of the recess 15. In addition, the width l, i.e. the diameter of the trim 23 is less than the width L of the recess, which width is the thickness of the reservoir in this example. Thus, the pump cannot come into contact with a substantially plane surface, and this is particularly advantageous in the event that the dispenser falls to the ground. The two protuberances 14 formed on either side of the recess 15 and that define the top wall 13 flank the pump 2 and protect it without it being necessary to add a protective cover. However, it is particularly easy to access the pusher 21 with a finger while holding the reservoir by the side walls 12.

By means of the invention, the dispenser member is protected in the event that it falls, by means of the particular configuration of the reservoir which defines a space that is difficult for a plane surface to access.

What is claimed is:

1. A fluid dispenser comprising:

a reservoir containing a fluid, said reservoir having a ton end, a bottom end opposite the top end, and side walls extending between the top end and the bottom end, said reservoir further having an opening and an outer periphery that defines a recess at the top end of the reservoir, said recess having at least one open side; and a dispenser member fitted to the opening of the reservoir;

wherein the dispenser member lies entirely within the recess and wherein the fluid dispenser is configured to normally stand upright on a horizontal surface with the bottom end of the reservoir resting on the surface.

2. A fluid dispenser according to claim 1, wherein said opening is formed in said recess and wherein said dispenser member is entirely received in said recess, so that the dispenser can be disposed in any position on a substantially plane surface without the dispenser member coming into contact with said surface.

3. A fluid dispenser according to claim 1, wherein said opening is formed at a bottom of said recess.

4. A fluid dispenser according to claim 3, in which the width of the recess is greater than or equal to the width of the dispenser member.

5. The fluid dispenser according to claim 4, wherein the fluid dispenser is operable to dispense the fluid using the dispenser member when the dispenser stands upright.

6. A fluid dispenser according to claim 3, in which the height of the recess is greater than or equal to the height of the portion of the dispenser member that projects from the opening.

7. The fluid dispenser according to claim 1, wherein said dispenser member includes a pusher that actuates the dispenser member to dispense the fluid.

8. The fluid dispenser according to claim 1, wherein said dispenser member is a pump.

9. The fluid dispenser according to claim 1, wherein said dispenser member is a valve.

10. The fluid dispenser according to claim 1, wherein the fluid is one of a perfume, a cosmetic, and a pharmaceutical.

11. The fluid dispenser according to claim 1, wherein the fluid dispenser is operable to dispense the fluid using the dispenser member when the fluid dispenser stands upright.

12. A fluid dispenser comprising:

a reservoir containing a fluid, said reservoir having a top end, a bottom end opposite the top end, and side walls extending between the top end and the bottom end, said reservoir further having an opening and an outer periphery that defines a recess at the top end of the reservoir, said recess having at least one open side; and a dispenser member fitted to the opening of the reservoir;

wherein the dispenser member lies entirely within the recess;

wherein said opening is formed at a bottom of said recess; and wherein the reservoir has two opposing protuberances that define the recess; and wherein the fluid dispenser is configured to normally stand upright on a horizontal surface with the bottom end of the reservoir resting on the surface.

13. The fluid dispenser according to claim 12, wherein the fluid is one of a perfume, a cosmetic, and a pharmaceutical.

14. A fluid dispenser comprising:

a reservoir containing a fluid, the reservoir having a top end, a bottom end opposite the top end, and side walls extending between the top end and the bottom end, said reservoir further having a fluid opening and an outer periphery that defines a recess at the top end of the reservoir and with a top opening and at least one open side; and a dispenser member having a nozzle, the dispenser member fitted to the fluid opening of the reservoir;

wherein the dispenser member that projects out from the fluid opening lies within the recess; and wherein the fluid dispenser is configured to normally stand upright on a horizontal surface with the bottom end of the reservoir resting on the surface.

15. The fluid dispenser according to claim 14, wherein the nozzle faces the at least one open side of the recess so that the fluid is dispensed from the at least one open side upon actuation of the dispenser member.

16. The fluid dispenser according to claim 15, wherein the dispenser member has a pusher that actuates the dispenser member upon depression of the pusher, and wherein the pusher is accessed from at least the top opening of the recess.

17. The fluid dispenser according to claim 14, wherein the recess has a second open side for accessing the dispenser member, the second open side located opposite the at least one open side of the recess.

18. The fluid dispenser according to claim 14, wherein the fluid opening is formed at a bottom of said recess.

19. The fluid dispenser according to claim 18, wherein a width of the recess is greater than or equal to a width of the dispenser member.

20. The fluid dispenser according to claim 18, wherein a height of the recess is greater than or equal to a height of a portion of the dispenser member that projects from the opening.

21. The fluid dispenser according to claim 14, wherein the reservoir has a side wall, and the at least one open side of the recess opens on the side wall of the reservoir.

22. The fluid dispenser according to claim 14, wherein the fluid is one of a perfume, a cosmetic, and a pharmaceutical.

23. A fluid dispenser comprising:

a reservoir containing a fluid, the reservoir having a top end, a bottom end opposite the top end, and side walls extending between the top end and the bottom end, said reservoir further having a fluid opening and an outer periphery that defines a recess at the top end of the reservoir and with a top opening and at least one open side; and a dispenser member having a nozzle, the dispenser member fitted to the fluid opening of the reservoir;

wherein the dispenser member that projects out from the fluid opening lies within the recess;

wherein the fluid opening is formed at a bottom of said recess; and wherein the reservoir forms a protuberance on each side of the recess; and wherein the fluid dispenser is configured to normally stand upright on a horizontal surface with the bottom end of the reservoir resting on the surface.

24. The fluid dispenser according to claim 23, wherein the fluid is one of a perfume, a cosmetic, and a pharmaceutical.

25. A fluid dispenser comprising:

a reservoir containing a fluid, said reservoir having an opening and an outer periphery that defines a recess, said recess having at least one open side; and a dispenser member fitted to the opening of the reservoir;

wherein the dispenser member lies entirely within the recess; and wherein said dispenser member is a pump.

26. A fluid dispenser comprising:

a reservoir containing a fluid, the reservoir having a fluid opening and an outer periphery that defines a recess with a top opening and at least one side opening; and a dispenser member having a nozzle, the dispenser member fitted to the fluid opening of the reservoir;

wherein the dispenser member that projects out from the fluid opening lies within the recess; and wherein the recess has a second side opening for accessing the dispenser member, the second side opening located opposite the at least one side opening of the recess.

27. A fluid dispenser comprising:

a reservoir containing a fluid, the reservoir having a fluid opening and an outer periphery that defines a recess with a top opening and at least one side opening; and a dispenser member having a nozzle, the dispenser member fitted to the fluid opening of the reservoir;

wherein the dispenser member that projects out from the fluid opening lies within the recess; and wherein the reservoir has a side wall, and the at least one side opening of the recess opens on the side wall of the reservoir.

* * * * *